United States Patent [19]

Mosburger

[11] Patent Number: 4,516,454

[45] Date of Patent: May 14, 1985

[54] STRAIGHT LINE CUTTING AND/OR GROOVE MACHINE FOR MOVING MATERIAL WEBS, ESPECIALLY FOR CORRUGATED PAPER WEBS

[75] Inventor: Hans Mosburger, Weiherhammer, Fed. Rep. of Germany

[73] Assignee: BHS-Bayerische Berg-, Hutten- und Salzwerke Aktiengesellschaft, Munich, Fed. Rep. of Germany

[21] Appl. No.: 459,960

[22] Filed: Jan. 21, 1983

[30] Foreign Application Priority Data

Jan. 29, 1982 [DE] Fed. Rep. of Germany ..... 3202914

[51] Int. Cl.[3] ..... B26D 7/26; B26D 5/02; B26D 1/24

[52] U.S. Cl. ..... 83/499; 83/425.4; 83/504

[58] Field of Search ..... 83/499, 498, 504, 425.4; 493/65, 367, 366, 475

[56] References Cited

U.S. PATENT DOCUMENTS

| | | | |
|---|---|---|---|
| 3,750,513 | 8/1973 | Cromeens | 83/499 X |
| 3,760,697 | 9/1973 | Besemann | 83/499 X |
| 3,877,335 | 4/1975 | Lange | 83/504 X |
| 3,886,833 | 6/1975 | Gunn et al. | 83/499 |
| 4,320,677 | 3/1982 | Tahara | 83/504 X |

FOREIGN PATENT DOCUMENTS

| | | |
|---|---|---|
| 2142117 | 3/1972 | Fed. Rep. of Germany . |
| 2250125 | 4/1974 | Fed. Rep. of Germany . |
| 3202914 | 8/1983 | Fed. Rep. of Germany . |

*Primary Examiner*—James M. Meister

*Attorney, Agent, or Firm*—Silverman, Cass & Singer, Ltd.

[57] ABSTRACT

Straight line cutting and/or groove machine for moving material webs, especially for corrugated paper webs. The machine has at least one drive station with several interacting tool pairs for cutting or grooving the material web. The tools are located above and below the material web. The upper and lower tools are firmly clamped on a shifting tube by a controlled braking mechanism. The shifting tube is fastened on a slide part which sits on an adjustment spindle and is driven by a positioning motor. The tools are clamped on a shifting tube in the desired intervals spaced adjacent to each other. The straight line cutting and/or groove machine permits rapid, precise positioning of the tools.

12 Claims, 4 Drawing Figures

STRAIGHT LINE CUTTING AND/OR GROOVE MACHINE FOR MOVING MATERIAL WEBS, ESPECIALLY FOR CORRUGATED PAPER WEBS

BACKGROUND OF THE INVENTION

1. Field of the Invention

This invention relates generally to a straight line cutting and/or groove machine for moving material webs, and more particularly for moving corrugated paper webs.

2. Description of the Prior Art

Smaller and smaller operations are carried out by corrugated paper installations for a format with shorter running times, that is to say, higher working speeds. Accordingly, shorter and shorter changeover times are required for the tools for straight line cutting and/or groove machines which form a component part of such a corrugated paper installation. Straight line cutting and/or groove machines according to German Pat. No. DE-PS 2 250 125, published Apr. 25, 1974, reach mean changeover times of about 10 seconds in the case of a simple arrangement. This is too long for a modern corrugated paper installation. In order to be able to realize shorter changeover times, it is becoming more and more common to set up two straight line cutting and/or groove machines in succession in a so-called tandem-arrangement. While one machine is in operation, the tools of the other machine are positioned for the succeeding operation.

When format change is to be effected, the upper and lower tools of the machine in operation are removed and simultaneously the positioned tools of the second machine are engaged. The required changeover time from one machine to the other amounts to about 1 second in this case. The machine according to said German Pat. No. DE-PS 2 250 125 is too expensive for use in the tandem arrangement, since each tool has its own drive spindle, and a drive motor, and an actual value transmitter and evaluation electronics are assigned to each tool pair.

machine is

Another straight line cutting and/or groove machine is known according to German Pat. No. DE-PS 2 142 117, published Mar. 2, 1972. A gripping arrangement is used for positioning. The tool bodies are moved by a moving carriage for the purpose of positioning and the gripping device releases the tool body actually to be positioned. If all tool bodies are moved, they are pneumatically or hydraulically braced on the tool shaft. The disadvantage of the aforementioned machine is that considerable dimensional differences occur in the movement operation thereof, especially when affixing the tool body because the tool bodies are very short in relation to the shaft diameter and thus are difficult to adjust when they get the slightest bit dirty.

This invention focuses on improving the machine disclosed in the aforementioned patents while maintaining the separation of the guide shafts and the drive shafts in such a way that the high expenditure of adjustment units is avoided.

SUMMARY OF THE INVENTION

This invention offers the advantage that the straight line cutting and/or groove machine can be built more cheaply because only one positioning drive is necessary. Only six adjustment spindles and slide parts are necessary for a machine with three tool stations according to a design variation. Moreover, shifting of the entire machine is not necessary to effect web edge correction. Finally, it is possible to mount additional tool bodies without widening the machine, thus guaranteeing a minimum deflection of the transverse holder for guiding the tool pairs. In addition, an easier change of tools, minimum adjustment times with the format change, and high adjustment accuracy are achieved.

DESCRIPTION OF THE PREFERRED EMBODIMENTS

Figure 1:
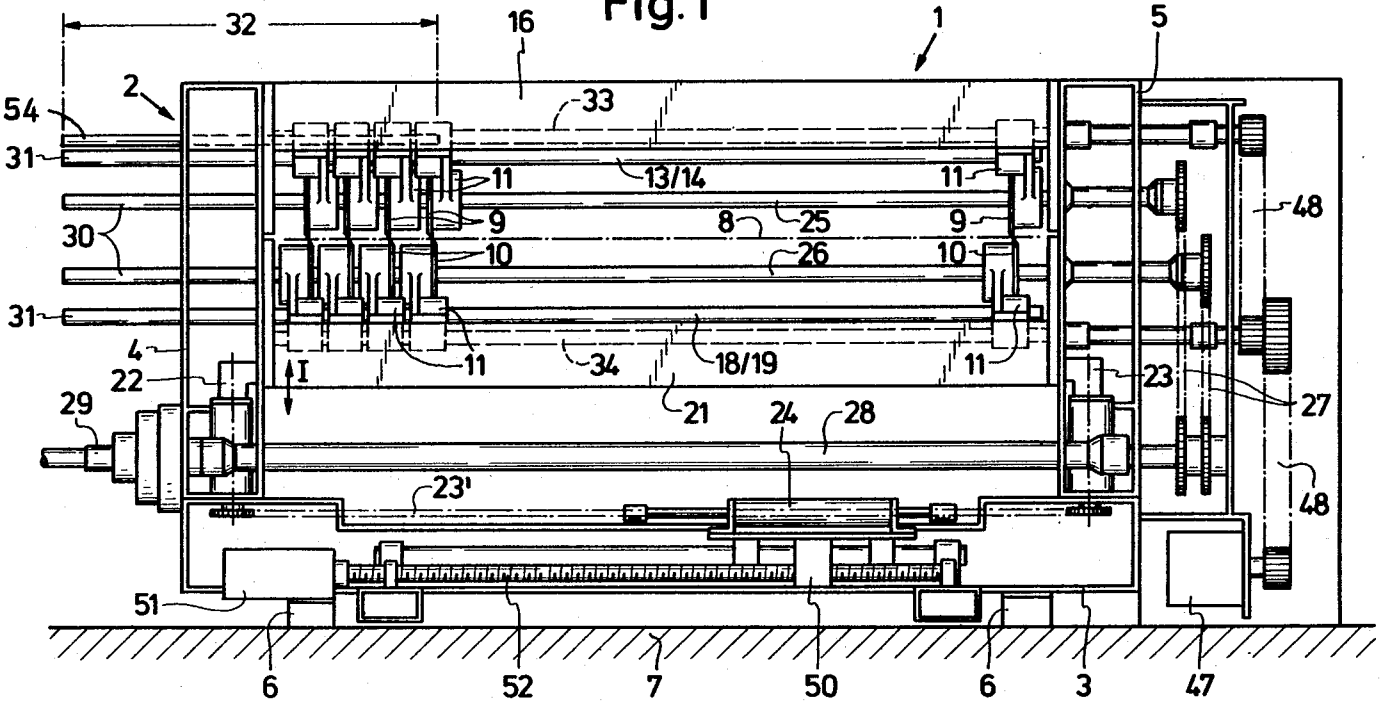
FIG. 1 is a side elevational view of a straight line cutting and/or groove machine in accordance with the invention.
Figure 2:
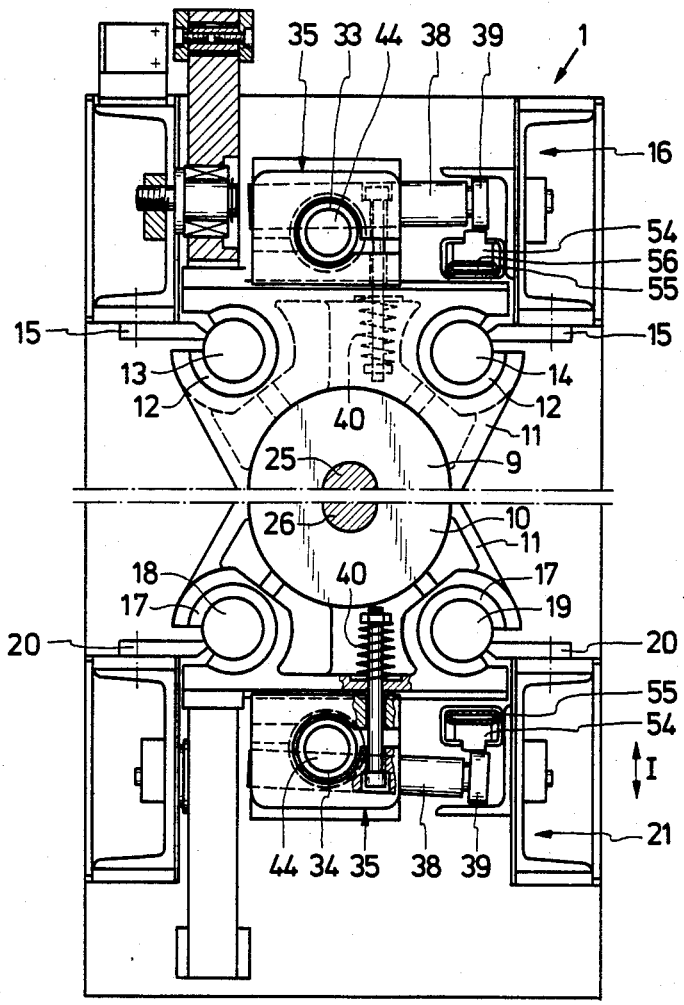
FIG. 2 is a vertical cross-sectional view through the guide for the tool body of said machine.

In the following description, the moved material web is a corrugated paper web which is moved in a horizonal plane through the straight line cutting and/or groove machine 1.

The straight line cutting and/or groove machine 1 or 1' has a frame 2, which includes a yoke-like basic frame part 3 and lateral stand parts 4 and 5. The basic frame part 3 is connected in a stationary manner with the foundation 7 over foundation slide rails 6. Tools 9, 10 are arranged above and below the corrugated paper webs 8 which are illustrated in dashed lines. An upper tool 9 and a lower tool 10 work together as a tool pair.

In the straight line cutting and/or groove machine 1, different tools are arranged behind each other as viewed in the lengthwise direction of the web, running vertical with respect to the running direction of the corrugated paper web 8, as for example cutting knife or grooving tools. Preferably, cutting knives are combined with the trailing grooving tools, so that corrugated paper 8 running through the machine can be cut lengthwise and cardboard blanks to be manufactured in a similar manner can be grooved. The same tools, e.g. cutting knives or grooving tools, are provided in a tool station in the same transverse plane.

The tools above and below the corrugated paper web 8 shown in FIG. 1 are cutting knives, whereby actually one cutting knife is combined above and below the corrugated paper web 8 into one tool pair. Each cutting knife 9 above and each cutting knife 10 below the corrugated paper web 8 is mounted in an interchangeable manner in a carriage-like tool body 11. The tool bodies 11 for the upper tools 9 are mounted in a shiftable or movable manner along parallel guide rods 13, 14 by means of ball bearings 12. The guide rods 13, 14 are fastened by means of fasteners 15 on a rigid transverse carrier 16. The transverse carrier 16, which is formed of U-rails connected with each other by parallel legs and on the end by front plates arranged at distances from each other, rigidly connects the upper ends of lateral stand parts 4 and 5.

The tool bodies 11 of the lower tools 10 are likewise guided in a shiftable manner by means of ball bearings 17 on parallel guide rods 18, 19 arranged in intervals. The guide rods are fastened on a transverse carrier 21 by means of fasteners 20. The rigid transverse carrier 21 is formed by two parallel U-rails connected with each other by means of front plates on the ends and separated from each other by an interval. The transverse carrier 21 can be shifted heightwise in the direction of the arrow I and is connected by lateral stand parts 4, 5.

For providing height adjustment of the transverse carrier 21, lateral lifting spindles 22, 23 are connected with carrier 21. Spindles 22, 23 are driven over an endless chain 23' jointly by a pressure medium cylinder acted upon from both sides by a piston rod passing through a pneumatic cylinder 24, for example. In this manner, the tools 9, 10 can be moved over from their effective position by lowering the lower transverse carrier 21 and thus the tools 10, carried by the carrier into the outer effective position, are movable into a new position.

The individual tools 9, 10 above and below the corrugated paper web 8 are actually driven by drive shafts 25, 26, which run centrally through the tools 9, 10, e.g. knives. The drive shafts 25, 26 are splined. By means of shaft keys, their rotational movement is transmitted to the tools, which can be shifted along the rotating shafts 25, 26. The drive shafts 25, 26 extended out over the lateral stand part 4. Outside of lateral stand part 5, the drive shafts 26, 25 are connected by drive shafts (not shown) and by chains 27 to be driven by a shaft 28, which is driven through clutch 29 by the main drive (not shown) of the entire corrugated paper installation.

The shaft parts 30 jutting over the lateral stand part 4 and the guide rod parts 31 likewise projecting over lateral stand part 4 enable the tool pairs to be moved into a rest space 32.

Shifting tubes 33 and 34 function to move the tools 9, 10. Tubes 33, 34 run between the U-rails of the upper transverse carrier 16 and the lower transverse carrier 21, and thereby run parallel to the guide rods 13, 14 and 18, 19. The shifting tubes 33, 34 cross through shoe brakes 35, which are formed on the tool bodies 11. Each shoe brake 35 has a swivelled wedge 36 with a brake shoe lining 37. Swivel wedge 36 includes a wedge arm 38 which has a roller 39 on its free end.

The brake shoes 36 are actuated into clamping position by a spring arrangement 40, by which the tool bodies 11 are then clamped firmly on the shifting tubes 33 and 34 associated therewith. In order to shift the tool bodies 11 and thus the tools 9, 10 when the shoe brake 35 is loosened, the operator uses a shifting mechanism which embraces a slide part 41. One end of each shifting tube 33, 34 is firmly connected with said slide part 41.

A spindle nut 43 is firmly connected with the nut flange 42 of the slide part 41. An adjustment spindle 44 is threaded there through. Said adjustment spindle is mounted by means of a bearing 45 in the lateral stand part 5 or in the adjustable transverse carrier 21. The adjustment spindle 44 passes centrally through each shifting tube 33, 34. The free end of spindle 44 is carries a bearing 46 shiftable in the shifting tubes 33 and 34. Adjustment spindle 44 can be driven by a positioning motor 47. The adjustment spindles 44 are connected with each other by toothed belts 48. The shifting tubes 33, 34 are mounted in the shoe brakes 35 by friction bearing 49.

Since all tool bodies 11 can be clamped on the shifting tubes 33, 34, and since the shifting of all shifting tubes 33, 34 takes place by a single positioning motor 47, the web edge correction, that is to say the proper positioning of the tools to the actual lateral edge of the corrugated paper web, can take place by the positioning drive, so that the machine no longer need be shiftable.

Figure 4:
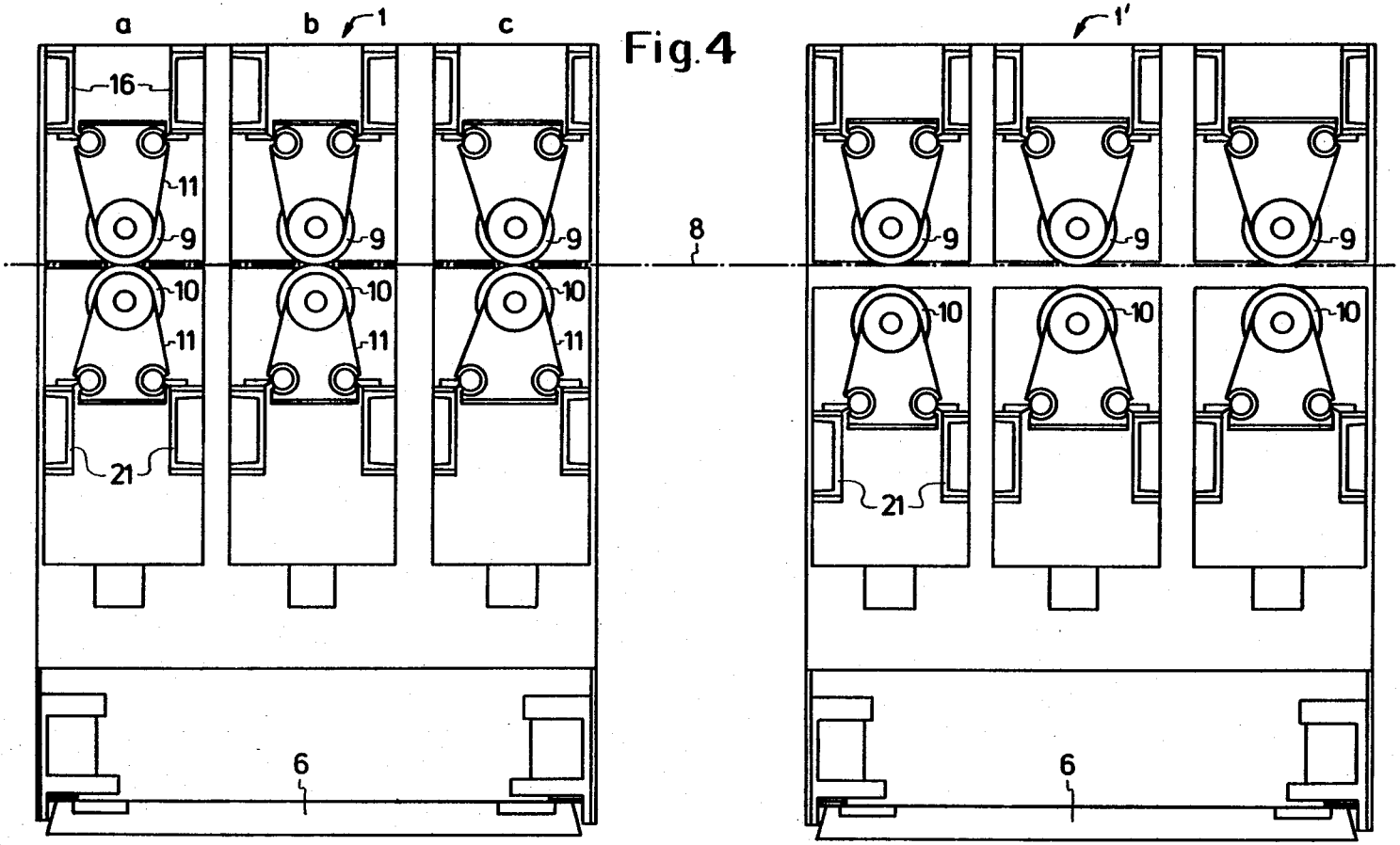
FIG. 4 is a front elevational view of said straight line cutting and/or groove machine in tandem arrangement.

The moving in and out of the tool pairs of the individual work stations, which are actually formed by tools pairs of a vertical plane, takes place by pneumatic cylinders 24. A cylinder 24 is assigned to each tool station. As is evident from FIG. 4, in the illustrated embodiment the straight line cutting and/or groove machine 1 has three tool stations a, b, c, arranged behind each other as viewed from the web direction. Thus, three pneumatic cylinders 24 are present. The individual cylinders 24 are arranged on a common carriage 50, which is driven by a brush-shifting motor 51 through an adjustment spindle 52. The moving in and out motion of the tool pairs of the individual tool stations can take place separately with this arrangement. The adjustment of the tool stations, the so-called groove depth adjustment, takes place in common for all three stations by adjustment of the carriage 50 by the brushshifting motor 51.

The tool bodies 11 of each tool 9, 10 are usually firmly clamped on the shifting tubes 33, 34 by the spring arrangement 40 and the shoe brakes 35. The clamping of the tool bodies 11 on the shifting tubes 33, 34 can be loosened in the area of the rest or park space 32. The rest space begins behind a catch 53 (see FIG. 3).

Loosening of the clamping of the tool bodies 11 on the shifting tubes 33, 34 takes place when it is desired to remove the tool bodies 11 for a new positioning. For this purpose, the roller 39 arranged on the brake shoe arm 38 extends over a conductor rail ramp 54 extending lengthwise over the rest space 32, which is mounted so as to be moved vertically in a holding rail or channel 55 which is C-shaped in cross-sectional configuration. The bottom side of each conductor rail ramp 54 can be acted upon by an inflatable pad 56. If the conductor rail ramp 54 is moved vertically by pressure pad 56 until it is limited by the support bars, the shoe brake is loosened the by movement of roller 39 and of the moving brake shoe connected with it; thus the clamping of the tool body 11 on the shifting tubes 33 and 34 is loosened. When the shoe brake 35 is loosened, each tool body 11 can be moved relatively easily on the respective shifting tubes 33 and 34. Thus, additional tool bodies 11 can be easily mounted onto the projecting shaft parts or guide rod parts, or tool bodies can be exchanged.

As is apparent from FIG. 1, the rest space 32 extends outside of the frame 2 of the machine 1 and therefore, the machine width can be kept small despite positioning of many tools 9, 10. The danger of bending of the transverse carrier 16 and 21 is reduced and the adjustment accuracy is increased. The catch 53 is mounted so as to be able to swivel. It can be actuated by a piston rod 58 of a pressure medium cylinder 57. In topmost indexing position, the pawl nose 59 engages with a locking part 60 of the tool body 11. The cylinder 57 operates with two different closing pressures. The closed position of the catch 53 is controlled by a limit switch (not shown).

The positioning operation of tools 9, 10 takes place as follows:

(A) Removing:

Tools 9, 10 are located in their positioned places. The tools of each tool pair are in their positioned places, i.e., separated, for which purpose the transverse carrier 21 is lowered with the tool bodies 11 and the lower tools 10. The catch 53 is opened by moving the pawl nose 59 upward somewhat in counterclockwise direction to allow the locking parts 60 of the tool bodies 11 to pass freely therethrough.

It is assumed that the slide part 41 at the same time is connected with the tool body 11 of the first tool (e.g. zero knife). When the positioning motor 47 is turned on, the clamped tools 11 are shifted or moved in the direction of rest space 32 over adjustment spindle 44, slide part 41, and shifting tubes 33 and 34 while maintaining their positions relative to one another. When entering into the rest space 32, the shoe brake 35 is loosened with the running of roller 39 onto the extended conductor rail ramp 54, and thus the clamping connection between the tool body 11 and the shifting tube 33 and 34 is loosened. The gradually arriving tool bodies 11 shove the already unclamped tool bodies 11 further and further into the rest space 32. After all tool bodies 11 are disconnected in the rest space 32, and the slide part 41 has reached its zero mark with the limit switch (not shown), the removal operation is concluded. A subsequent positioning operation can begin.

Figure 3:
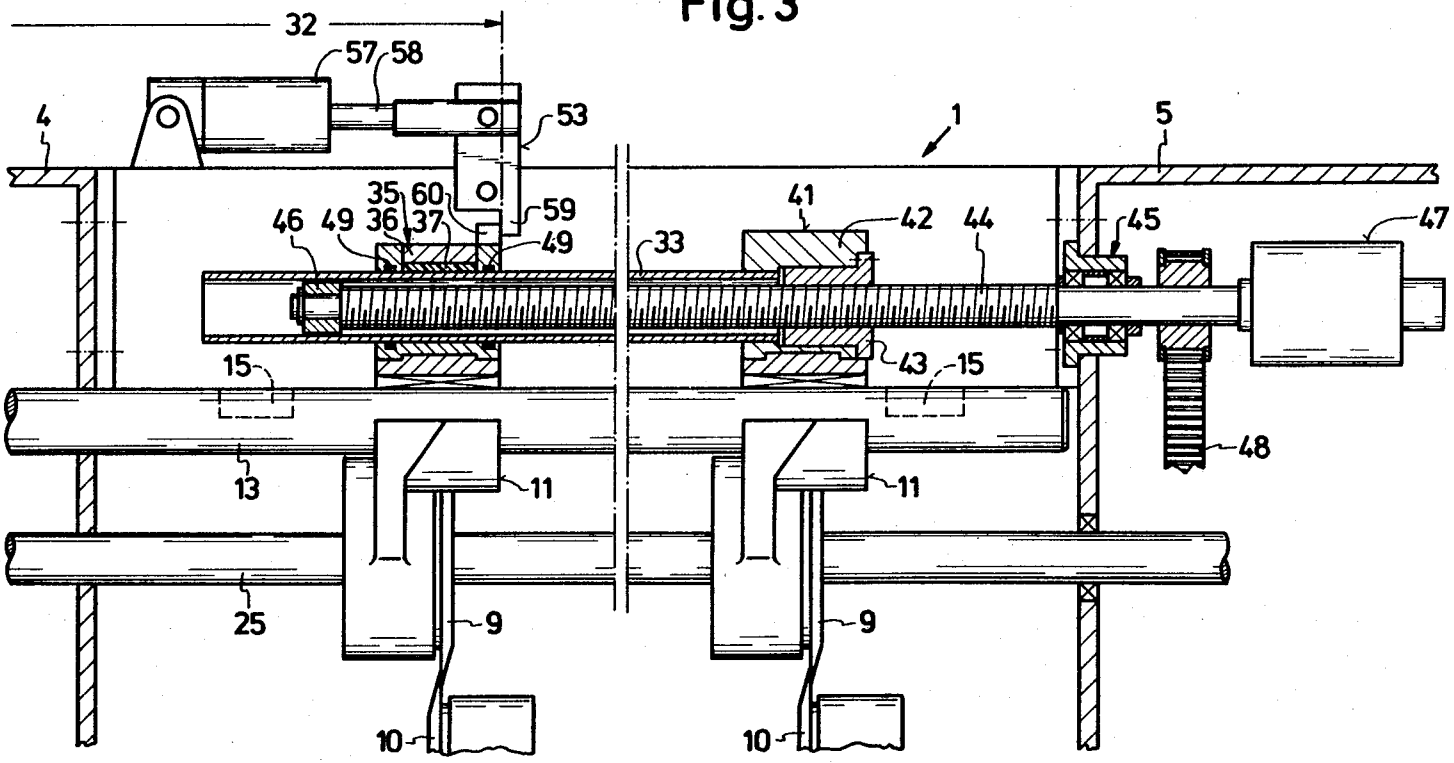
FIG. 3 is a vertical longitudinal cross-sectional view through the adjustment mechanism for the tool body of said machine.

(B) Positioning of the Tools:

The catch 53 is actuated by the cylinder 57 into the closed position (FIG. 3). The cylinder 57 first operates with low pressure. The conductor rail ramp 54 has descended. Due to this, all the tool bodies 11 are clamped on shifting tubes 33 and 34 in their adjacent position in the rest space. The positioning motor 47 drives the adjustment spindle 44 with reverse rotational direction. The counting of a position counter (not shown) begins at zero when the slide part 41 travels over a switch point (not shown) given by the limit switch. The slide part 41 is moved by the adjustment spindle 44 from the direction of the rest space 32. The trailing tool body 11 runs against the pawl nose 59 of the catch 53 and presses the same up somewhat at the low pressure of the cylinder 57. By this action, a pawl limit switch (not shown) is actuated. The conductor rail ramp 54 is moved up, due to which action the tool bodies 11 on the shifting tubes 33 and 34 are unclamped. The cylinder 57 for the catch 53 is switched to a higher pressure, due to which action the adjacent tool body 11 is pressed back safely into its zero position. This zero position must correspond to the switch point, at which the positioning counter begins to count.

As soon as the adjusted dimension is reached between the first tool and the following tool, the positioning drive is stopped, the conductor rail ramp 54 is moved down, the tool bodies found in the rest space are clamped firmly on the shifting tubes 33 and 34, and the catch 53 is opened.

The positioning drive first starts with reduced regulating speed. As soon as the locking part 60 of the trailing tool body 11 has left the catct pawl nose 59 (limit switch control), the catch 53 closes with low pressure.

The catch 53 is pressed upward by the next following tool body 11, the conductor rail ramp 54 is moved up, the tool bodies 11 still found in the rest space are unclamped, tne catch cylinder 57 is switched to higher pressure, due to which action the third tool body 11 is pressed into zero position and the positioning drive switches to maximum variable control rate and stops again when reaching the set dimension between the second and the third tool. After this action, the described operation is repeated until all tools are positioned. The last positioning step results in all tools being firmly clamped on the shifting tubes being correctly spaced with respect to each other and being shifted together further until the zero knife is aligned with the pre-selected web edge.

Instead of providing a slide part 41 for each tool station for each adjustment spindle, only one common slide part can be present for all upper and all lower halves of several tool stations, in the present case, for example, three. Because of this, the adjustment spindles can be eliminated and the adjustment drive is simplified.

Minor variations in the structure and other variations in the arrangement and size of the various parts may occur to those skilled in the art without departing from the spirit or circumventing the scope of the invention as set forth in the appended claims.

I claim:

1. A straight line cutting and groove machine through which material webs are moved comprising, a plurality of cooperable pairs of rotatable tools arranged with one of each pair on one upper side of the web and the other of each pair on the opposite lower side of the web, guide members arranged transverse to the lengthwise direction of the web with the tools movably mounted along said guide members, drive means for effecting movement of the tools, adjustment means for shifting the tools along the guide members, a driven adjustment spindle associated with all of said tools on one side of the web and another driven adjustment spindle associated with all of said tools on the other side of said web, each spindle having a slide part and a shifting tube rigidly connected thereto, a controlled braking mechanism connected with each tool and operable together with the shifting tube, and a controlled retaining mechanism for moving each tool to a rest position.

2. A machine as claimed in claim 1 in which the slide part is formed with a tool body and the slide part has a spindle nut for the adjustment spindle.

3. A machine as claimed in claim 2 in which each shifting tube coaxially surrounds its associated adjustment spindle and one end thereof is fastened on said slide part.

4. A machine as claimed in claim 1 in which said adjustment spindles are rotatably mounted respectively on a lateral stand part or transverse carrier, said spindles being movable and extending over the maximum width of the web into a rest space for the tools.

5. A machine as claimed in claim 4 in which said adjustment spindles carry a bearing on a free end thereof for receipt therein of a respective shifting tube.

6. A machine as claimed in claim 1 in which the tools have tool bodies which each include a normally actuated brake shoe, said brake shoes being deactivated by a roller in contact with a conductor-rail ramp which is reciprocally movable, said ramp extending over a space defining the rest position for the tools.

7. A machine as claimed in claim 1 in which each tool includes a retaining mechanism having a pawl and cooperable fittings on the tools.

8. A machine as claimed in claim 7 in which said pawls can be actuated by a rotating-drive cylinder which is controllable at two holding pressures, said pawls being cooperable with a transmitter which controls the holding pressure of said drive cylinder.

9. A machine as claimed in claim 1 in which the drive means for the tools include drive shafts, said shafts and guide members extending beyond a lateral stand part of said machine, said shifting tubes being shiftable to project over said stand part.

10. A machine as claimed in claim 1 in which the drive means for the tools include drive shafts, said shafts and the shifting tubes projecting over a lateral stand part of said machine on the side lying opposite the rest position for the tools.

11. A machine as claimed in claim 1 in which several tool pairs are arranged behind each other in the web running direction, and all spindles are driven in common by a positioning motor.

12. A machine as claimed in claim 1 in which each guide member includes a lifting mechanism which can be shifted vertical, there being a plurality of drives for several tool stations which are arranged on an adjustable carriage.

* * * * *